United States Patent [19]

Caruso et al.

[11] 4,317,054

[45] Feb. 23, 1982

[54] BANDGAP VOLTAGE REFERENCE EMPLOYING SUB-SURFACE CURRENT USING A STANDARD CMOS PROCESS

[75] Inventors: Michael J. Caruso, Carrollton; David B. Hildebrand, Bedford; Kul B. Ohri, Carrollton, all of Tex.

[73] Assignee: Mostek Corporation, Carrollton, Tex.

[21] Appl. No.: 119,539

[22] Filed: Feb. 7, 1980

[51] Int. Cl.[3] ..... G05F 1/56

[52] U.S. Cl. ..... 307/297; 323/313; 307/355

[58] Field of Search ..... 307/297, 304, 310, 355, 307/359; 323/1, 4, 9, 16, 17, 22 R, 22 T, 68, 69, 313, 314; 330/10, 259, 260, 300

[56] References Cited

U.S. PATENT DOCUMENTS

| | | | |
|---|---|---|---|
| 3,887,863 | 6/1975 | Brokaw | 323/22 T X |
| 4,059,793 | 11/1977 | Ahmed | 323/22 T X |
| 4,064,448 | 12/1977 | Eatock | 307/297 X |
| 4,087,758 | 5/1978 | Hareyama | 330/260 X |
| 4,146,903 | 3/1979 | Dobkin | 307/297 X |
| 4,191,900 | 3/1980 | Redfern et al. | 307/355 |

OTHER PUBLICATIONS

Gilbert, "Wideband Negative-Current Mirror"; *Electronic Letters;* vol. 11, No. 6, pp. 126-127, 3/20/1975.

Widlar, "New Developments in IC Voltage Regulators"; *IEEE-JSSC;* vol. SC-6, pp. 2-7, 2/1971.

Kuijk, "A Precision Reference Voltage Source"; *IEEE-JSSC;* vol. SC-8, pp. 222-226, 6/1973.

Brokaw, "A Simple Three Terminal IC Bandgap Reference"; *IEEE-JSSC;* vol. SC-9, pp. 388-393, 12/1974.

Vittoz et al., "A Low Voltage CMOS Bandgap Reference"; *IEEE-JSSC;* vol. SC-14, pp. 573-577, 6/1979.

Tzanateas et al., "A CMOS Bandgap Reference"; *IEEE-JSSC;* vol. SC-14, pp. 655-657, 6/1979.

*Primary Examiner*—Larry N. Anagnos

[57] ABSTRACT

A bandgap voltage reference employing only subsurface currents wich may be fabricated using a standard CMOS process. The reference includes first and second vertical bipolar transistors having common collectors formed in an integrated circuit substrate. A first resistor connects the emitter of the first transistor to ground potential. A second resistor connects the emitter of the second transistor to a reference node while a third resistor connects the reference node to ground. A differential amplifier has a positive input connected to the reference node, a negative input connected to the first transistor emitter and an output connected to the bases of the first and second transistors and also providing the reference voltage output. In a preferred form the output of the differential amplifier is buffered by a third transistor and coupled by a resistive divider to the first and second transistor bases so that the reference voltage may be selected at any scalar of the basic bandgap voltage.

19 Claims, 4 Drawing Figures

BANDGAP VOLTAGE REFERENCE EMPLOYING SUB-SURFACE CURRENT USING A STANDARD CMOS PROCESS

BACKGROUND OF THE INVENTION

The present invention relates to voltage reference circuits for use in integrated circuits and more particularly to a true bandgap voltage reference useful in CMOS integrated circuits.

References known to the present applicants and believed to be relevant to the present invention include the following publications.

R. J. Widlar, "New Developments in IC Voltage Regulators", IEEE Journal of Solid State Circuits, Vol. SC-6 pp. 2–7, February 1971;

K. E. Kuijk, "A Precision Reference Voltage Source", IEEE Journal of Solid State Circuits, Vol. SC-8, pp. 222–226, June 1973;

A. P. Brokaw, "A Simple Three Terminal IC Bandgap Reference", IEEE Journal of Solid State Circuits, Vol. SC-9, pp. 388–393, December 1974;

E. A. Vittoz, et al, "A Low Voltage CMOS Bandgap Reference", IEEE Journal of Solid State Circuits, Vol. SC-14, pp. 573–577, June 1979; and G. Tzanateas, et al, "A CMOS Bandgap Voltage Reference", IEEE Journal of Solid State Circuits, Vol. SC-14, pp. 655–657, June 1979.

The first three of the above publications teach the basic concept of bandgap voltage references and the need for such precise circuits. Each of the particular circuits provided in these publications is quite suitable for fabrication on typical bipolar integrated circuits where isolated transistors are available. Each of the circuits is based on the principle that by the proper combination of a base-emitter voltage, $V_{BE}$, of one transistor with the difference in base-emitter voltages, $\Delta V_{BE}$, of two transistors operating at different current densities a reference which is stable over a wide range of temperatures can be achieved. By proper scaling the positive temperature coefficient of the $\Delta V_{BE}$ term will balance the negative temperature coefficient of the $V_{BE}$ term itself. The circuit taught by Widlar provides a stable voltage reference based on this principle but is generally limited to an output voltage no greater than the bandgap voltage itself.

The circuits taught in the Brokaw publication provide a resistive divider in the feedback loop to the transistors establishing the reference voltage so that the actual output voltage may be essentially any scaler of the basic bandgap voltage.

The Kuijk publication teaches yet another bandgap voltage source similar in principle to the Brokaw and Widlar devices, but employing two diode connected transistors. The output voltage for this circuit is generally limited to the bandgap voltage or some integral multiple thereof which may be achieved by stacking multiple references.

The circuits taught in each of these three publications provide very good reference voltages that are generally suited for use only on standard bipolar integrated circuits. It is also desirable to provide accurate voltage references in MOS type integrated circuits. These first three types of circuits are however not suitable for conventional MOS processing since they all require the use of bipolar transistors having isolated collectors. Such transistors can be provided in MOS circuits but only at the expense of added processing steps so that the overall process could not be considered a conventional MOS or CMOS process.

The last two of the above publications address the problem of providing good voltage references in CMOS integrated circuits without requiring the use of additional processing steps.

The circuits of the last two references both rely on a circuit known as a proportional to absolute temperature circuit constructed entirely of MOS transistors which provides an output which is combined with the base-emitter drop of a single bipolar transistor formed on a CMOS integrated circuit. While such an arrangement is conceptually sound, it is susceptible to surface effects such as surface traps and contamination since the MOS devices are surface devices. In addition, the MOS proportional to absolute temperature circuitry relies on a weak inversion region of operation of the MOS devices over the temperature range of interest thereby requiring careful control of operating conditions. In the Tzanateas, et al configuration the output is generally limited to the bandgap voltage and stacking of the circuits to obtain other reference potentials would be difficult since the negative terminal of the output voltage is floating. The circuit provided by Vittoz, et al operates at low input voltages and with low current requirements but it is sensitive to resistor ratios, the ratios of MOS device dimensions are large, and the bias point is offset by leakage currents even at room temperature. In any case, as noted in the last sentence of the Vittoz publication, the voltage references thus far provided on CMOS chips are not nearly as accurate as true bipolar bandgap references and this reduction in quality has been accepted as a tradeoff to avoid additional processing steps in the CMOS circuits.

SUMMARY OF THE INVENTION

Accordingly, an object of the present invention is to provide a true bipolar bandgap voltage reference circuit suitable for fabrication on CMOS integrated circuits.

Another object of the present invention is to provide an accurate bandgap voltage reference circuit which may be fabricated using conventional CMOS processing.

A bandgap voltage reference circuit according to the present invention includes first and second bipolar transistors having common collectors formed in a integrated circuit substrate, first, second and third resistors, and a differential amplifier. The first resistor is connected between the emitter of the first transistor and ground. The second resistor is connected between the emitter of the second transistor and a reference node. The third resistor is connected between the reference node and ground. The differential amplifier has its negative input connected to the first transistor emitter, its positive input connected to the reference node, and its output coupled back to the bases of both the first and second transistors with the output of the differential amplifier also providing the reference potential output. The circuitry provides different current densities in the two transistors and appropriately combines the base-emitter voltage of the first transistor with the difference in base-emitter voltages of the first and second transistors to provide a temperature stabilized bandgap output. Feedback from the amplifier output to the two transistor bases may be through a resistive divider to provide a reference potential at any desired scalar of the basic bandgap voltage.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
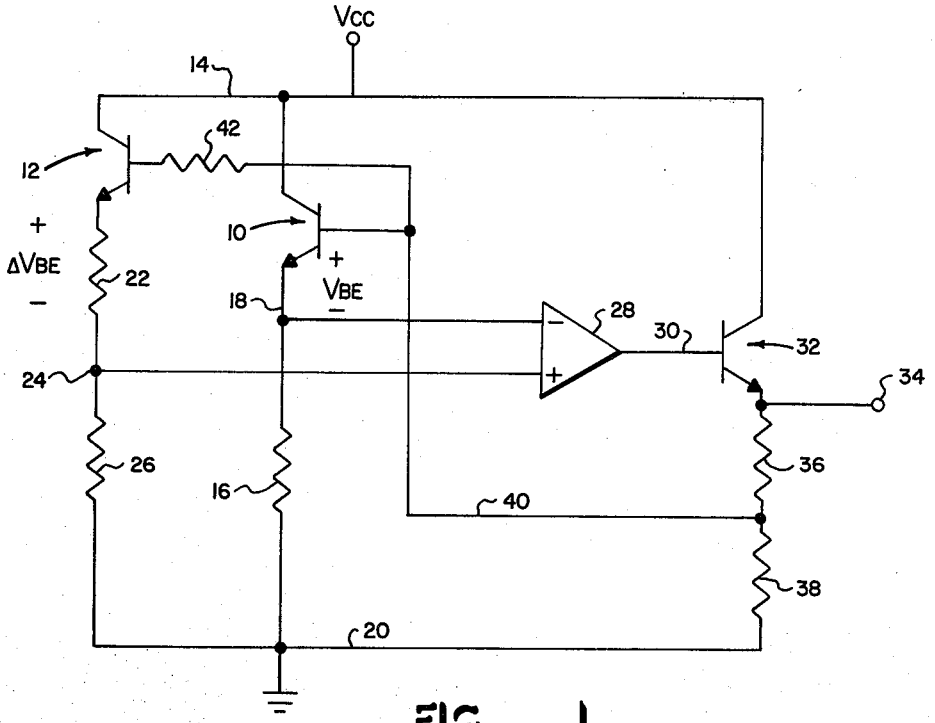
FIG. 1 is a schematic diagram of a CMOS compatible bandgap voltage reference circuit according to the present invention.

With reference now to FIG. 1, there is provided a schematic diagram of a preferred embodiment of the present invention. The circuit includes first and second transistors 10 and 12 each having a collector connected to the positive supply, $V_{CC}$. The positive supply line 14 is formed in a conventional CMOS process by the substrate of the circuit and transistors 10 and 12 have collectors formed in this substrate. A first resistor 16 is connected between a node 18 to which the emitter of transistor 10 is connected and ground potential at node 20. A second resistor 22 is connected between the emitter of transistor 12 and a node 24 in common with a third resistor 26 which is also connected to the ground node 20. A differential amplifier 28 has a negative or inverting input connected to node 18 and a positive or noninverting input connected to node 24. An output 30 of amplifier 28 is connected to the base of a third transistor 32 which has an emitter connected to an output node 34 of the voltage reference circuit. A resistor divider comprising the series combination of resistors 36 and 38 is connected from the output node 34 to the ground node 20 and has an intermediate node 40. The node 40 is connected to the base of transistor 10 and through a resistor 42 to the base of transistor 12.

In the preferred embodiment the base-emitter area of transistor 10 is smaller than the corresponding area of transistor 12. Operation of the circuit can be understood by considering two possible conditions of the voltage on node 40 which is the feedback voltage to the bases of transistors 10 and 12, ignoring the compensating resistor 42, the operation of which will be discussed below. When the voltage on feedback node 40 is lower than desired, the larger junction area of transistor 12 causes it to conduct proportionally more current than transistor 10. The extra current through resistor 26 as compared to the current in resistor 16 causes the positive input of amplifier 28 to be above the negative input. As a result, the output 30 of amplifier 28 increases in voltage which increases is coupled to node 40 and thereby to the bases of transistors 10 and 12. On the other hand, if the voltage on node 40 is higher than desired, the voltage drop across resistor 22 becomes significant and limits the current through transistor 12 so that it becomes proportionally smaller than the current in transistor 10. As a result of this imbalance, the inverting input of amplifier 28 is driven to a voltage above the positive input and the output 30 of amplifier 28 is driven to a lower voltage. Again, this output voltage is coupled through node 40 to the bases of transistors 10 and 12 to thereby reduce the current. Thus, it is seen that there is an intermediate voltage on node 40 at which the voltages at nodes 18 and 24 are equal and a stable voltage on output 34 results.

Operation of the circuit of FIG. 1 can also be explained in terms of the bandgap voltage references such as taught in the first three publications listed above. In general, those references teach that a temperature stable reference potential can be generated by summing a bipolar transistor base-emitter drop proportionally with the difference in base-emitter drops of two bipolar transistors operating at different current densities, with the proportional sum equalling approximately the bandgap voltage. The base-emitter drop of transistor 10, labelled $V_{BE}$ in the drawing, provides the basic base-emitter voltage for this reference. The $\Delta V_{BE}$ voltage appears across resistor 22 and is equal to the difference in base-emitter drops of transistors 10 and 12. It can be seen that amplifier 28 maintains the nodes 18 and 24 at essentially equal potentials. By ignoring the effect of resistor 42 and summing loop voltages it is seen that any difference in potential between the base-emitter drops of transistors 10 and 12 appears across resistor 22. Since resistor 26 is in series with resistor 22 it is seen that a voltage equal to the ratio of resistance of resistor 26 to that of resistor 22 times $\Delta V_{BE}$ appears across resistor 26. This same voltage therefore appears across resistor 16. The voltage at node 40, which is connected to the base of transistor 10, is therefore equal to the base-emitter drop of transistor 10 plus a scalar times the difference in base-emitter drops of transistors 10 and 12. When the voltage at node 40 is established at the bandgap voltage for the particular semiconductor material, a temperature stable potential is achieved. It is apparent that the output 30 of amplifier 28 may be connected directly to node 40 if a reference potential equal to the bandgap voltage is desired and the output 28 has sufficient current capacity. Transistor 32 merely acts to buffer the output 30 of amplifier 28 and provides sufficient current capacity to drive the output node 34. Resistors 36 and 38 merely divide the voltage on output 34 so that the output voltage may be any desired scalar of the basic bandgap reference potential.

The resistor 42 placed in series between node 40 and the base of transistor 12 is included to compensate the output voltage for the voltage drop occurring in resistor 36 as a result of the base currents flowing into transistors 10 and 12. Thus, it is seen in general that the voltage on output 34 is effected by the gains of transistors 10 and 12 which are both process and temperature dependent. By proper selection of resistor 42 these variations can be closely compensated for. The resistors 36 and 38 are needed only when an output voltage above the basic bandgap voltage is desired and therefore the resistor 42 is also needed only when a potential in excess of the bandgap voltage is desired.

For proper operation of the circuit of FIG. 1, several assumptions must be made. First, it must be assumed that the currents into amplifier 28 inputs are equal to zero. Second, it must be assumed that the operational amplifier 28 input offset voltage is invariant with temperature and equivalent to zero. Lastly, it must be assumed that the alphas of transistors 10 and 12 are equivalent. In the preferred embodiment, amplifier 28 is a chopper stabilized amplifier as described with respect to FIGS. 2, 3, and 4 and the assumptions concerning input current and input offset voltages can be safely made. As to the third assumption, the alphas can be closely matched by proper orientation and close spacing of the transistors 10 and 12 in the integrated circuit layout.

The resistors employed in the preferred embodiment were formed internally as diffused resistors on the integrated circuit. Non-uniformity and nonlinearity of such diffused resistors does effect the circuit performance to some extent. Better performance could of course be achieved by using thin film resistors in the circuit if the extra space is available, or by using external devices. However, the nonuniformity of the resistors is minimized by centroid layout of unit resistances and integral stepping form. In addition, the nonlinearity of the resistors is to some extent compensated for by the fact that it is only the ratios of the various resistances which actually determine the output voltage. The effects of nonuniform back gate bias and resistor geometry should also be taken into account when diffused resistors are employed.

It can be seen that the circuit thus far described is fully compatible with conventional CMOS integrated circuit processing. That is, all the bipolar transistors 10, 12 and 32 are formed with collectors in common with the substrate. As will be seen below the operational amplifier 28 is preferrably a chopper stabilized amplifier comprising only MOS transistors. While being fully compatible with the standard CMOS process the reference potential circuit does not depend upon any MOS transistor for establishing the actual reference potential. Thus, performance on the order of the reference circuits used in conventional bipolar circuits is achieved in a CMOS integrated circuit without requiring any additional processing steps.

Figure 2:
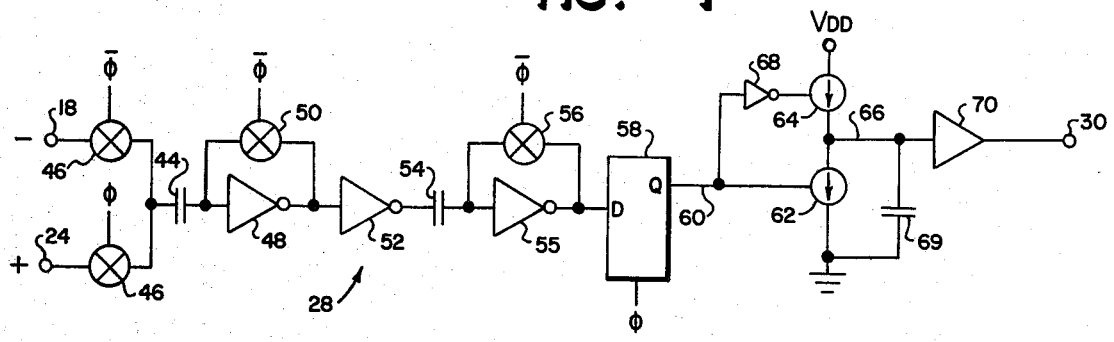
FIG. 2 is a block diagram of a preferred differential amplifier for use in the circuit of FIG. 1.

With reference now to FIG. 2, there is provided a circuit diagram of a preferred chopper stabilized amplifier generally designated 28. Amplifier 28 includes a negative or inverting input 18, a positive or noninverting input 24 and an output 30. Inputs 18 and 24 are alternately connected to an input capacitor 44 by a pair of MOS switches 46 controlled by alternate phases of a two phase clock. Capacitor 44 couples the input signal to the input of a first inverter 48 having another MOS switch 50 connected from input to output. The output of inverter 48 is connected to the input of a second inverter 52 having an output connected to one side of a second capacitor 54. The second side of capacitor 54 is connected to the input of a third inverter 55 which is also bypassed by another MOS switch 56. MOS switches 50 and 56 are controlled by the same phase of a two phase clock. The output of inverter 55 is coupled to the D input of a flip-flop 58 which is triggered by one of the two clock phases. The Q output 60 of flip-flop 58 controls the operation of two switchable current sources 62 and 64. The output 60 directly controls current source 62 which pulls current from a node 66 to ground potential. The node 60 is coupled through an inverter 68 to control the current source 64 which provides current from the positive power supply to node 66. By this arrangement it can be seen that at any given time one, but only one, of the current sources 62 and 64 is operating to either supply current to or drain current from the node 66. An integrating capacitor 69 is coupled between node 66 and ground potential to provide a voltage corresponding to the integral of the total current supplied to node 66. A buffer amplifier 70, typically a source follower, has an input coupled to node 66 and a low impedance output connected to the output 30 of the amplifier 28.

Figure 3:
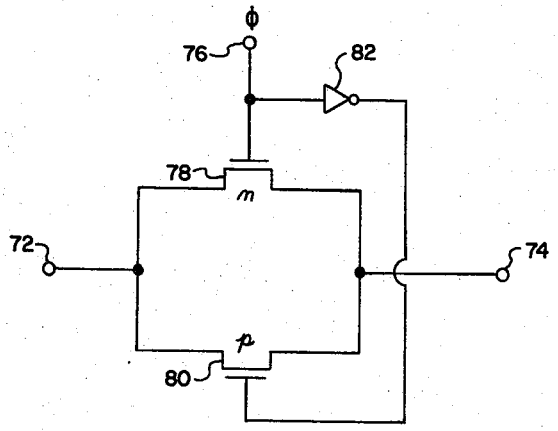
FIG. 3 is a schematic illustration of the clocked switches employed in the FIG. 2 circuitry.

With reference to FIG. 3 there is provided a schematic diagram of an MOS switch suitable for use as switches 46, 50 or 56 in FIG. 2. The switch of FIG. 3 has an input 72 which is selectively shorted to an output 74 under control of a clock input 76. An n-channel transistor 78 and a p-channel transistor 80 are connected in parallel between the input 72 and output 74. The gate of transistor 78 is connected directly to input 76 while the gate of transistor 80 is connected by means of a inverter 82 to the clock input 76. This switch arrangement insures that input 72 may be shorted to output 74 over the entire range of available operating voltages.

Figure 4:
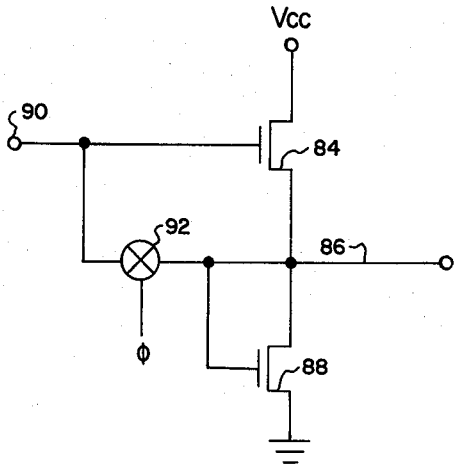
FIG. 4 is a schematic illustration of the inverters employed in the FIG. 2 circuitry.

With reference to FIG. 4 there is provided a schematic illustration of a switch bypassed inverter such as inverters 48 and 55 of FIG. 2. The inverter comprises a first MOS transistor 84 connected from the positive power supply $V_{CC}$ to an output node 86. A second transistor 88 is connected from the output terminal 86 to ground potential. The gate of transistor 84 is connected to an input 90 of the inverter. The gate of transistor 88 is connected to output terminal 86 of the device. An MOS switch 92 is illustrated between the input 90 and output 88 of the inverter and may be the same as the switch of FIG. 3. The circuitry of FIG. 4 without the switch 92 would preferably be used for inverter 52 of FIG. 2.

In general, the operation of the FIG. 2 chopper stabilized amplifier can be seen as a sequential sampling of the two input voltages and controlling of the ramp voltage occurring at output 30 in response to the relative voltages at the inputs. Thus, on the complementary portion of each clock period the inverting input 18 is coupled to the input capacitor 44. Assuming the clock periods are long enough, the input current reaches a zero level and the voltage on input 18 stabilizes. During this complementary clock phase, it is seen that switches 50 and 56 are closed causing inverters 48 and 55 to be biased at an intermediate voltage level at both input and output instead of being biased at either a logical zero or one level. As the complementary clock phase goes to zero and the primary clock phase is raised to a one level the positive input 24 is connected to capacitor 44 and the switches 50 and 56 are opened. If the voltage on input 24 at this point in time is higher than the stabilized voltage on input 18, the input to inverter 48 increases and its output is driven to a zero level. Inverter 52 is then driven to provide a one level at capacitor 54 and in turn drives inverter 54 to a zero level output. The D flip-flop 58 is triggered on this positive clock phase to store a logic level received on its D input. Thus, for the next clock period a zero logic level appears at the Q output 60 of flip-flop 58. During this clock period, the current source 62 is therefore deactivated and source 64 is activated by inverter 68 to supply steady current to node 66 and in turn cause the voltage of capacitor 69 and output 30 to ramp upwards. It can likewise be seen that if at the next sample interval the positive input 24 is lower than the negative input 18, the states of current sources 62 and 64 are reversed and the output 30 begins to ramp downwards. The overall result is that amplifier 28 provides an essentially analog output using digital devices almost exclusively. It can also be seen that amplifier 28 is quite simple and may be easily fabricated on a CMOS integrated circuit. It will be desirable in most cases that capacitor 69 be fairly large and therefore provided as an external component.

In selecting the particular values for the components of a voltage reference circuit according to FIG. 1 several factors should be considered. The $\Delta V_{BE}$ voltage is primarily a function of the difference in current densities in transistors 10 and 12. In general, this $\Delta V_{BE}$ term should be in the range of 70 millivolts to 100 millivolts. The differences in current densities can be achieved by either providing different base-emitter junction areas in transistors 10 and 12 or biasing transistors 10 and 12 at different current levels as determined by resistors 16 and 26. In a preferred form of the present invention, both differential areas and different bias currents are provided. Thus, in this embodiment, transistor 10 has a junction area of two square mils (1 mil=0.001 inch) while transistor 12 has an area of sixteen square mils. Resistor 16 has a value of 4.48 kilohms while resistor 26 has a value of 8.96 kilohms. These values for resistors 16 and 26 provide bias current of 128 microamps in transistor 10 and 64 microamps in transistor 12. The combined effect of the differential junction areas and bias currents is that transistor 10 has a current density sixteen times higher than that of transistor 12. Resistor 12 has a value of 1.12 kilohms so that, in combination with resistor 26, the $\Delta V_{BE}$ term is multiplied by a factor of eight when it is combined with the $V_{BE}$ of transistor 10. At the design current density of transistor 12, $\Delta V_{BE}$ should be equal to 72 millivolts. Based on these design values, the voltage on node 40 should be 1.218 volts. Resistors 36 and 38 are selected to provide an output voltage on terminal 34 of 2.5 volts and to provide bias currents through the resistors at least an order of magnitude greater than the base currents in transistors 10 and 12 to reduce the effect of these base currents on the output voltage. Thus, resistor 36 was selected to have a value of 2.55 kilohms while resistor 38 was given a value of 2.44 kilohms.

Resistor 42 as noted above is provided to compensate for the increase in output voltage resulting from the base currents of transistors 10 and 12 flowing through resistor 36. In this preferred embodiment, resistor 42 has a value of 375 ohms selected to reduce the effective $\Delta V_{BE}$ term by an amount sufficient to reduce the voltage on node 40 by the same amount as the increase in voltage due to the base currents flowing through resistor 36. As noted above, these particular values for this embodiment are intended to provide a output voltage of 2.5 volts and were arrived at after several experimental versions were tested. It is believed that this circuit should provide a temperature stability of approximately 50 ppm over the military temperature range which is much better than other voltage references used on CMOS integrated circuits. If other reference voltages are desired it will be necessary to provide other resistance values in the circuit. Other modifications and the component values may also be called for to improve stability and bias points of the various components. Also as noted above, the use of thin film or discrete resistors having better temperature coefficients should improve the performance of the circuit if better temperature stability is desired.

While the present invention has been illustrated and described in terms of particular apparatus and methods of operation, it is apparent that other modifications and changes can be made within the scope of the present invention as defined by the appended claims.

What is claimed is:

1. A bandgap voltage reference for use with CMOS integrated circuits comprising:

first and second bipolar transistors having common collectors formed in an integrated circuit substrate;

a first resistor connected between the emitter of said first transistor and a ground potential node;

a second resistor connected between the emitter of said second transistor and a reference node;

a third resistor connected between said reference node and said ground potential node;

a differential amplifier having a positive input connected to said reference node and a negative input connected to said first transistor emitter, and an output coupled to bases of said first and second transistors, said output providing a temperature stabilized reference potential.

2. A voltage reference according to claim 1, further including:

a fourth resistor coupled between said differential amplifier output and a second reference node; and a fifth resistor connected between said second reference node and said ground potential node;

wherein said second reference node is coupled to said bases of said first and second transistors.

3. A voltage reference according to claim 2, further including:

a sixth resistor connected between said second reference node and said second transistor base;

wherein said second reference node is connected directly to said first transistor base.

4. A voltage reference according to claim 1, further including:

a third transistor having a collector formed in said integrated circuit substrate, a base connected to said differential amplifier output and an emitter coupled to said first and second transistor bases.

5. A voltage reference according to claim 1, wherein the base-emitter junction areas of said first and second transistors and the values of said first, second and third resistors are selected to provide a reference potential at said differential amplifier output having a minimum temperature drift.

6. A voltage reference according to claim 1, wherein:

said differential amplifier is a chopper stabilized amplifier fabricated from MOS devices on the same substrate as said first and second bipolar transistors.

7. In an integrated circuit bandgap voltage reference circuit of the type in which the base-emitter voltage of a bipolar transistor is combined with the difference in base-emitter voltages of two bipolar transistors operating at different current densities to provide a temperature stable reference voltage the improvement comprising:

first and second bipolar transistors having common collectors for providing both said base-emitter voltage and said difference in base-emitter voltages of two transistors; and, a plurality of resistors connected between the emitters of said first and second transistors and a ground potential node to detect said base-emitter voltage and said difference in base-emitter voltage of said two bipolar transistors.

8. In the voltage reference circuit of claim 7, wherein said plurality of resistors comprises a first resistor coupled from the emitter of said first transistor to ground, a second resistor coupled from the emitter of said second transistor to a reference node, and a third resistor coupled from said reference node to ground said improvement further including:

a differential amplifier having a negative input connected to said first transistor emitter, a positive input coupled to said reference node, and an output coupled to bases of said first and second transistors, to provide, at said differential amplifier output, said temperature stable reference voltage.

9. In the voltage reference circuit of claim 8, wherein:

said differential amplifier comprises a chopper stabilized amplifier formed on the same substrate as said first and second bipolar transistors.

10. A bandgap voltage reference circuit comprising:

first and second bipolar transistors having common collectors formed in an integrated circuit substrate;

emitter follower circuit means coupled to said first and second bipolar transistors for establishing a preselected differential in base-emitter current densities in said first and second transistors; and means for combining the base-emitter voltage of said first transistor with a preselected multiple of the difference in base-emitter voltages of said first and second transistors to provide a temperature stable reference potential.

11. A voltage reference according to claim 10: wherein said means for combining includes means for multiplying said stable reference potential by a preselected amount to provide a preselected higher temperature stable reference potential.

12. A bandgap voltage reference circuit according to claim 10, wherein:

said emitter follower circuit means for establishing and said means for combining include:

a first resistor connected between the emitter of said first transistor and ground;

a second resistor connected between the emitter of said second transistor and a reference node;

a third resistor connected between said reference node and ground; and, amplifier means having inputs connected to said first transistor emitter and said reference node and an output coupled to bases of said first and second transistors for maintaining the voltages on said inputs substantially equal, said amplifier means output providing said temperature stable reference potential.

13. A bandgap voltage reference circuit according to claim 12, wherein:

said amplifier means comprises a differential amplifier having a negative input connected to said first transistor emitter, a positive input connected to said reference node and an output coupled to the bases of said first and second transistors.

14. A bandgap voltage reference circuit according to claim 13 wherein said differential amplifier is a chopper stabilized amplifier.

15. A bandgap voltage reference for use with CMOS integrated circuits comprising:

first and second bipolar transistors having common collectors formed in an integrated circuit substrate;

a first resistor connected between the emitter of said first transistor and a ground potential node;

a second resistor connected between the emitter of said second transistor and a reference node;

a third resistor connected between said reference node and said ground potential node;

a differential amplifier having a positive input connected to said reference node and a negative input connected to said first transistor emitter, and an output coupled to bases of said first and second transistors, said output providing a temperature stabilized reference potential;

said differential amplifier being a chopper stabilized amplifier fabricated from MOS devices on the same substrate as said first and second bipolar transistors, said chopper stabilized amplifier including first and second MOS switches coupled between said positive and negative amplifier inputs and a common input node, and two phase clock means coupled to said switches for alternately coupling said inputs to said node;

an input capacitor having a first plate connected to said input node and a second plate;

an odd number of MOS inverters connected in series, a first of said inverters having an input connected to said capacitor second plate;

at least a third MOS switch connected between the input and the output of at least said first inverter, said switch controlled by said two phase clock to be closed when said second MOS switch is closed;

a memory device having an input for receiving the output of the last of said inverters, said memory device controlled by said two phase clock to store the output of said last inverter on alternate clock phases; and, integrating output means including a switchable current source and a switchable current sink each having an input coupled to said memory device for alternately activating said source and sink in response to the state of said memory device, said source and sink each having an output coupled to a capacitor for charging said capacitor to a voltage controlling the reference potential.

16. A voltage reference according to claim 15 further including a buffer device having an input coupled to said capacitor and an output forming said differential amplifier output.

17. A bandgap voltage reference circuit comprising:

first and second bipolar transistors having common collectors formed in an integrated circuit substrate;

means for establishing a preselected differential in base-emitter current densities in said first and second transistors;

means for combining the base-emitter voltage of said first transistor with a preselected multiple of the difference in base-emitter voltages of said first and second transistors to provide a temperature stable reference potential;

wherein said means for establishing and said means for combining include a first resistor connected between the emitter of said first transistor and ground;

a second resistor connected between the emitter of said second transistor and a reference node;

a third resistor connected between said reference node and ground;

amplifier means having inputs connected to said first transistor emitter and said reference node and an output coupled to bases of said first and second transistors for maintaining the voltages on said inputs substantially equal, said amplifier means output providing said temperature stable reference potential;

said amplifier means including first and second clocked switching means for, on alternate clock phases, coupling one of said inputs to an input node;

an input capacitor having a first plate connected to said input node and a second plate;

at least one inverter having an input connected to said capacitor second plate and an output;

third clocked switching means for on alternate clock phases shorting said at least one inverter input to said inverter output;

clocked memory means having an input coupled to said at least one inverter output and an output for providing an indication of the state of the inverter output occurring on alternate clock phases; and, integrating output means having an input coupled to said memory means output and an output for providing an integral of said output, said integral indicating said temperature stable reference potential.

18. A bandgap voltage reference circuit according to claim 17, wherein said integrating output means comprises:

a switchable current source and a switchable current sink, said source and sink each having an input coupled to said memory means for alternately activating said source and sink in response to the state of said memory means, and each having an output coupled to an integrating node, and a capacitor coupled between said integrating node and a source of a reference potential.

19. A voltage reference circuit according to claim 18, further including a buffer device having an input coupled to said integrating node and an output forming said amplifier means output.

* * * * *